United States Patent [19]

Cottenceau et al.

[11] Patent Number: 4,827,740

[45] Date of Patent: May 9, 1989

[54] DEVICE FOR CONTROLLING THE KNITTING POSITIONS OF THE NEEDLES IN A KNITTING MACHINE

[75] Inventors: Rémi Cottenceau, Viry, France; Erwin Zürcher, Le Lignon; Jacques Vermot-Gaud, Perly, both of Switzerland

[73] Assignee: SIPRA, Albstadt, Fed. Rep. of Germany

[21] Appl. No.: 163,543

[22] Filed: Mar. 3, 1988

[30] Foreign Application Priority Data

Mar. 6, 1987 [CH] Switzerland ..... 840/87

[51] Int. Cl.[4] ..... D04B 7/00

[52] U.S. Cl. ..... 66/75.1; 66/220; 66/219

[58] Field of Search ..... 66/75.1, 75.2, 123, 66/121, 220, 221, 219

[56] References Cited

U.S. PATENT DOCUMENTS

| | | | |
|---|---|---|---|
| 3,262,285 | 7/1966 | Beguin et al. | 66/220 |
| 3,715,897 | 2/1973 | Hadam . | 66/75.2 |
| 3,892,108 | 7/1975 | Hadam | 66/75.2 |
| 4554,803 | 11/1985 | Schmodde et al. | 66/75.2 |
| 4,584,850 | 4/1986 | Haltenhof | 66/75.1 |

FOREIGN PATENT DOCUMENTS

| | | |
|---|---|---|
| 2412497 | 9/1975 | Fed. Rep. of Germany . |
| 1594994 | 7/1970 | France . |
| 1277169 | 6/1972 | United Kingdom . |

*Primary Examiner*—Ronald Feldbaum

*Attorney, Agent, or Firm*—Cushman, Darby & Cushman

[57] ABSTRACT

In a knitting machine, a needle position control device comprises knitting needles each having five butts, of which one is fixed and the four others are secured in pairs to two needle latches mounted for oscillation in two recesses formed in the stem of the needle. A selection mechanism acts on the latches so as to move one or the other of their two respective butts out of the guide trick of the needle. By means of this combination of butts, the motion of the needle in the three knitting positions is constantly controlled in both directions of motion of the needle, by moving out two of the three butts. Another embodiment comprising a single latch can give the same result for two knitting positions.

4 Claims, 5 Drawing Sheets

DEVICE FOR CONTROLLING THE KNITTING POSITIONS OF THE NEEDLES IN A KNITTING MACHINE

BACKGROUND OF THE INVENTION

The invention relates to a device for controlling the knitting positions of the needles of a knitting machine, of the kind in which each needle is mounted for longitudinal sliding in a guide trick and comprises at least one needle latch adapted to oscillate between two stops and provided with two butts near its respective ends, the butts being adapted to project from the trick and to be respectively and alternately retracted therein, the device comprising selection means for bringing the latches against one or more of the stops and thus selectively placing the butts in the projecting position, the device also comprising cams disposed opposite the latches and drive means for bringing about relative motion between the cams and the latches transversely to the guide tricks so that the cams exert pressure on the projecting butts in the longitudinal direction of the tricks as a result of the relative motion.

Difficult problems occur in controlling the knitting positions of the needles of a knitting machine in which each needle can occupy two or even three knitting positions plus one or two transfer positions, since it is extremely difficult to continuously monitor the position of the needle in its trick and in two opposite directions. If the needle is left to itself in either direction, there is a risk that the needle will move inadvertently, since the needle is subjected to various stresses which tend to move it along its guide trick and result in faults in the knitting. The stresses may come from the thread engaging the needle or from abrupt acceleration and impacts between the guide butts and the cams.

The conventional method of avoiding inadvertent movement of the needles consist in producing sufficient friction between the guide tricks and the needles, so that the needles are gripped between the two opposite edges of their respective tricks. Clearly this method has disadvantages even if it partly solves the problem. The friction increases the pressure between the cams and the butts on the needles and thus limits the permissible accelerations and consequently the speed of the loom. The friction on the needles increases the wear on the components and consequently the maintenance cost. It is also necessary to operate the machine at slow speed after cold starting, until it reaches a certain temperature after several hours of operation. In order to increase the speed of knitting looms, it will undoubtedly be necessary to solve the problem of controlling the needles.

An object of the invention is to provide a knitting machine in which the knitting needles are constantly guided in both directions of motion along their respective tricks, thus making it possible to considerably reduce the friction of the needles in the tricks.

SUMMARY OF THE INVENTION

The invention relates to a device for controlling the knitting positions of the needles of a knitting machine in which each needle is mounted for longitudinal sliding in a guide trick and comprises at least one needle latch adapted to oscillate between two stops and provided with two butts near its respective ends, the butts being adapted to project from the trick and to be respectively and alternately retracted therein, the device comprising selection means for bringing the latches against one or more of the stops and thus selectively placing the butts in the projecting position, the device also comprising cams disposed opposite the latches and drive means for bringing about relative motion between the cams and the needles transversely to the guide tricks so that the cams exert pressure on the projecting butts in the longitudinal direction of the tricks as a result of the relative motion, characterised in that each needle also comprises a fixed butt, the longitudinal position of a needle in its guide trick being controlled by simultaneous constant engagement of at least two cams with two edges, a top and bottom edge respectively, of the two butts projecting from the trick.

In addition to the advantages resulting from continuous guidance of the needles on the principle of a closed cam track, the great simplicity and the small number of components used in the invention are noteworthy. The system of selection at a single level is another great advantage of this invention and enables the height of the needle bed to be reduced.

BRIEF DESCRIPTION OF THE DRAWINGS

Two embodiments of a selection device according to the invention are diagrammatically illustrated by way of example in the accompanying drawings in which.

DESCRIPTION OF PREFERRED EMBODIMENTS

Figure 1:
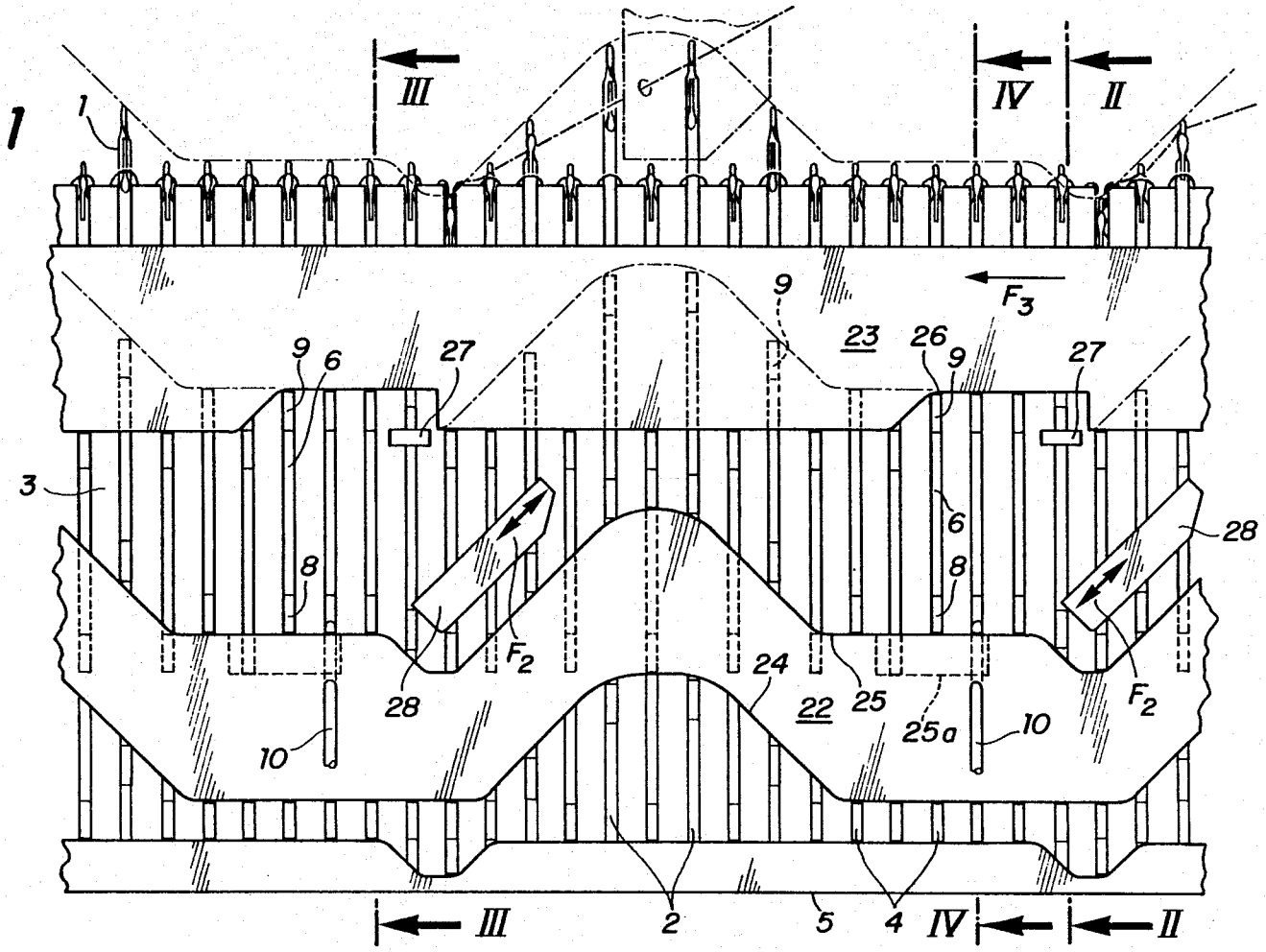
FIG. 1 is a view in partial elevation of a circular knitting machine comprising an embodiment of the selection device.

FIG. 1 is a partial view of a knitting machine comprising a number of knitting needles 1 slidably mounted in parallel tricks 2 of the needle bed 3. The dial levers (not shown) are mounted in radial tricks.

In the present example, needles 1 have a fixed butt 4 engaging a first cam track 5 and a latch 6 mounted for oscillation in a recess 7 formed in the stem of needle 1. The bottom of recess 7 is flat whereas the two sides **7*a*, 7*b* adjacent the bottom are in the form of arcs of a circle having its centre substantially below the bottom of recess 7. The edge of latch 6 has two sides 6*a*, 6*b* which includes an obtuse angle and are adjacent two arcs of a circle 6*c*, 6*d* respectively, which have the same diameter and the same radius as sides 7*a*, 7*b* of recess 7. Latch 6 has to butts 8, 9 in the form of a rectangular trapezium, the end face of the trapezium connecting the two parallel unequal sides being in line with the part of the stem of needle 1 in which the recess 7** is formed, when the butt is retracted into recess 7. When butt 8 or 9 is in the position outside the recess 7, its parallel unequal edges are perpendicular to the longitudinal axis of needle 1. As can be seen, movement of latch 6 from one to the other of its limiting positions is accompanied by a longitudinal movement of butts 8 and 9. This feature is very important, inter alia in that it can be used for self-locking of the latch, as will be explained hereinafter.

Although the needle described in this example comprises a latch 6 capable of controlling two positions, it is clear that a mechanism comprising two latches 6 per needle as described hereinafter can also be used with two devices of selection per feed, one for each latch.

A selection of this kind will now be described, referring more particularly to FIGS. 4 and 5. The selection means is a thin rod 10 slidably mounted via a cam 22, the free end of the rod being adapted to project beyond the contour of cam 22. The other end of rod 10 is secured to an electric conductor 12 disposed between the two poles of a permanent magnet 13. Conductor 12 preferably comprises a strip of copper or aluminium, the width of the rectangular section of which is placed in the plane of the air gap of the permanent magnet 13 in order to increase the rigidity of the conductor in this plane. The ends of these conductors are welded to two strips 14, 15 of CuAg forming bends and having sections bent at 90° with respect to the section of the conductive strip 12, so as make them flexible in the plane of the air gap. The ends of conductor 12, 14, 15 are secured to terminals 18, 19 connected to the secondary winding of a transformer 16, the primary winding of which is connected to a current pulse source 17.

When a current pulse I enters the electric conductor 22, a force F exerted on it. Since the end of conductor 12 are secured to strips 14, 15 which are deformable in the plane of the air gap, the force results in a movement of the conductor and of rod 10 attached thereto. If the direction of the current in conductor 12 is reversed, the direction of the force applied thereto is reversed.

Tests have been made with an aforementioned structure, using an electric conductor 12, 14, 15 made from a strip of CuAg 50 μm thick and 0.7 mm wide. The distance between the securing terminals 18, 19 was 3 cm. The rod 10 proper was made of tungsten wire 0.35 mm in diameter, and the magnetic induction in the air-gap of magnet 13 was 0.5 Tesla. 5 A pulses lasting 0.5 μs resulted in a measured displacement of rod 10 of the order of 0.3 mm. As will be seen hereinafter, this displacement is sufficient to present the selection. Of course, the parameters can be modified. Also, the electromechanical conversion can be improved by disposing an aluminium conductor 12 in the air gap of the permanent magnet 13. The efficiency is given by the formula:

$$\eta = 0.5\ (B^2T/\rho d)$$

where

B = induction

T = duration of pulse $\rho$ = restivity d = density.

In the case of copper, the product $\rho d$ is approximately $1.8 \times 10^4$. Whereas in the case of aluminium the product $\rho d$ is $0.73 \times 10^4$. It is therefore possible, in the case of a given displacement of rod 10, to reduce the pulse duration and consequently to increase the frequency. The magnetic induction may also be raised to 0.8 Tesla and the current pulses can be 10 A.

Figure 4:
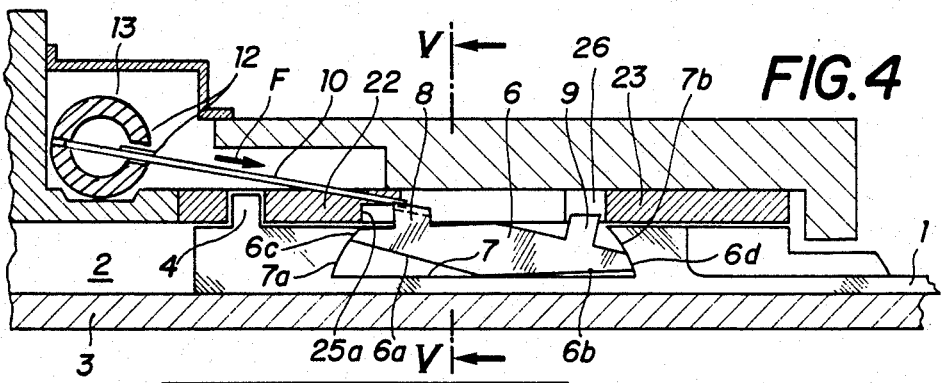
FIG. 4 is a view in section along line IV—IV of FIG. 1.
Figure 5:
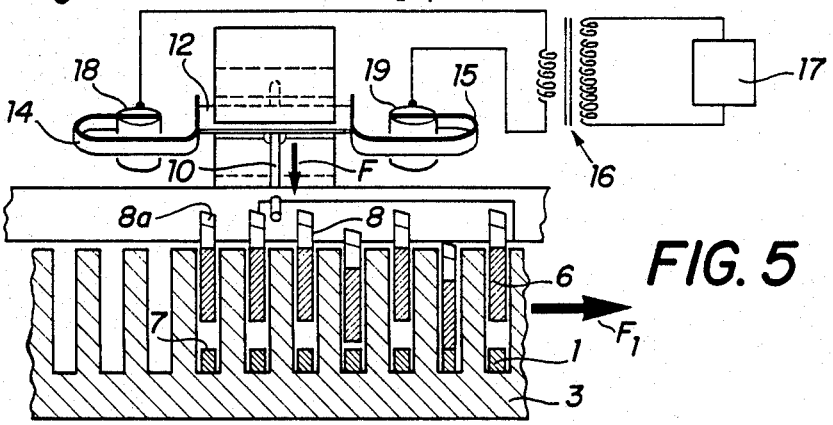
FIG. 5 is a view in section along line V—V of FIG. 4.

As shown more particularly in FIG. 5, the end faces 8 A of the trapezoidal butts 8 are bevelled, so that when the end of rod 10 has advanced into the path of butts 8, the bottom edges of the bevelled surfaces 8*a* meet the rod 10, and when the bevel moves in the direction of arrow $F_1$ it acts on latch 6 in the same way as a cam, so as slightly to move latch 6 into the position shown in FIG. 4.

Figure 2:
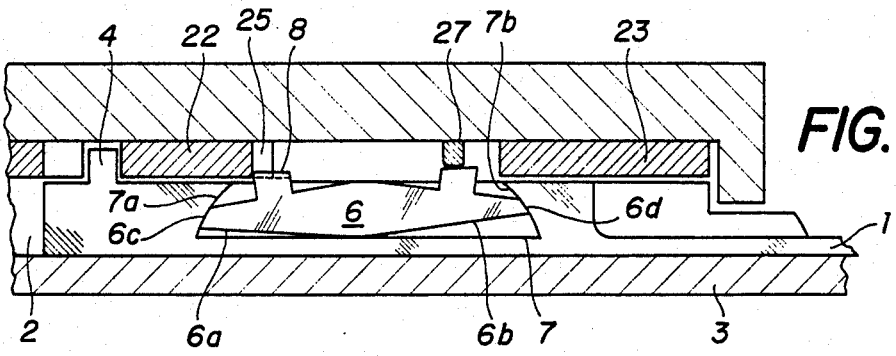
FIG. 2 is a view in section along line II—II of FIG. 1.
Figure 3:
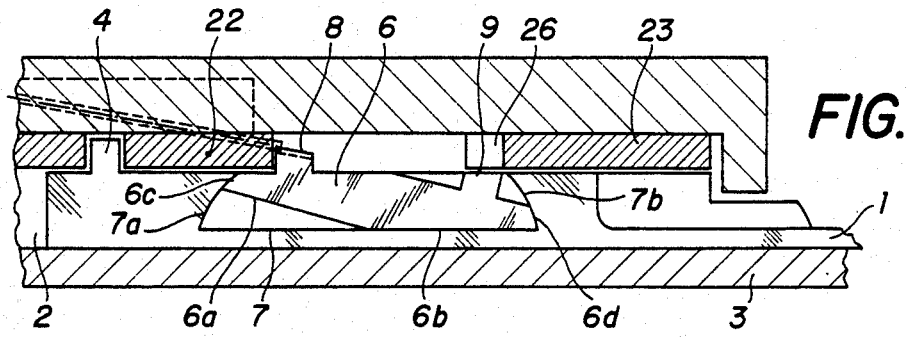
FIG. 3 is a view in section along line III—III of FIG. 1.

As FIGS. 1 and 2 show, the selection presetting mechanism which has just been described in detail is associated with two cams 22, 23 disposed on either side of the respective trajectories of butts 8, 9 of latches 6. Cam 22 has two substantially parallel contours, a bottom contour 24 and a top contour 25. Cam 23 has a contour 26, the purpose of which will be explained hereinafter. As FIG. 1 shows, the rod 10 actuating the selection presetting mechanism is movable between two positions, one in which it projects from the contour of cam 25 and is in the trajectory of butts 8 which then project from recesses 7 in needles 1. The selection presetting mechanism is preceded by a fixed cam 27 (FIGS. 1 and 2) disposed in the trajectory of butts 9 when they are in the position outside the recesses 7.

FIG. 1 also comprises clamping cams 28 adapted to move in reciprocation in the direction of the double arrow $F_2$. Note furthermore that in continuation of the actuating rod 10, the edge of cam 25 has a recess 25*a* enabling butts 8 to pivot in recess 7.

At the end of a feed, after all the butts 8, after coming out of recess 7, pass under the clamping cam 28, which lowers the needles, the fixed butts 4, which engage in the cam part formed between the cam contours 5 and 24, hold the needles at their initial level with their butts 8 inserted into recesses 7, and have thus passed behind the clamping cam 28. Consequently the butts 9 of needles 1 are outside the recess 7, so that when butts 9 pass under the fixed cam 27, it slightly tilts them through a few tenths of a mm, so that butt 8 rises a corresponding amount out of recess 7 as illustrated in FIG. 2. Referring to FIG. 1, it can be seen that by coming out of recess 7 in this manner, the end of butt 8 engages against the contour of cam 25 in a rising part thereof which follows the cam 27, the needles 1 moving in the direction of arrow $F_3$. Since furthermore the fixed butt 4 of the same needles has engaged under a horizontal part of cam 24 and thus prevents the needles from rising, the butt 8 engaged against the rising part of the contour of cam 25 pivots the latch 6 and extracts butt 8 and retracts butt 9 into recess 7. The reason is that since the centre of the circle bounding the sides 7*a*, 7*b* and 6*c*, 6*d* respectively is disposed substantially below the bottom of recess 7, any action exerted on butt 8 substantially perpendicular to the parallel surfaces of its contour (a rectangular trapezium) produces a torque on the latch which tends to pivot it. When its edge 6*b* touches the bottom of recess 7, the parallel surfaces of the trapezoidal contour of butt 8 are perpendicular to the longitudinal axis of needle 1.

Consequently, when butts 8 arrive opposite the actuating rod 10 slidably mounted via cam 22 in a duct which opens into the cam contour 25, the butts are all in the position outside the recess 7. There are two more possibilities: either rod 10 is retracted from contour 25 of cam 22, butt 8 remains outside and butt 9 engages behind cam 23 as illustrated by dotted lines, so that latch 6 is locked in this position; or alternatively, rod 10 extends slightly beyond the contour 25 of cam 22 and meets a butt 8 as illustrated in FIG. 4. Corresponding to the situation with the fixed cam 27, the rod 10 slightly tilts butt 8 by engaging against its bevelled end surface 8*a*. Simultaneously, butt 9 comes out of the recess and engages against the contour 26 of cam 23. Since this contour has a descending slope and the fixed butt 4 of needle 1 is guided between the horizontal parts of cams 5 and 24, latch 6 pivots in accordance with the same process as described hereinbefore, thus extracting the butt 9 and retracting the butt 8. Butt 8 can move owing to the recess 25*a* formed in the contour of cam 22. Butt 8 then moves behind cam 22 as shown by dotted lines, and thus locks latch 6 in this position, and the needle is guided in horizontal motion by butts 4 and 9 engaging the horizontal parts of the contours of cams 5 and 26.

The other needles, whose butts 8 are not being actuated by rod 10, remain outside and engaged against the contour 25 of cam 22, whereas the fixed butts 4 engage against the parallel contour 24 of cam 22. In the parallel part of contours 24 and 25, cam 22 moves the needles 1 into the knitting position with positive guidance of the needles both during rising and descending.

In the case of a three-position selection of needles, i.e. loop tucking and non-knitting, each needle 1 has two latches 6 each actuated by a rod 10. In this case each lever always presents one of its two butts and consequently there are three different combinations. The following description is of an embodiment of this kind in relation to a flat loom. Adaptation to a circular machine will be a simple matter for the skilled addressee.

Figure 6:
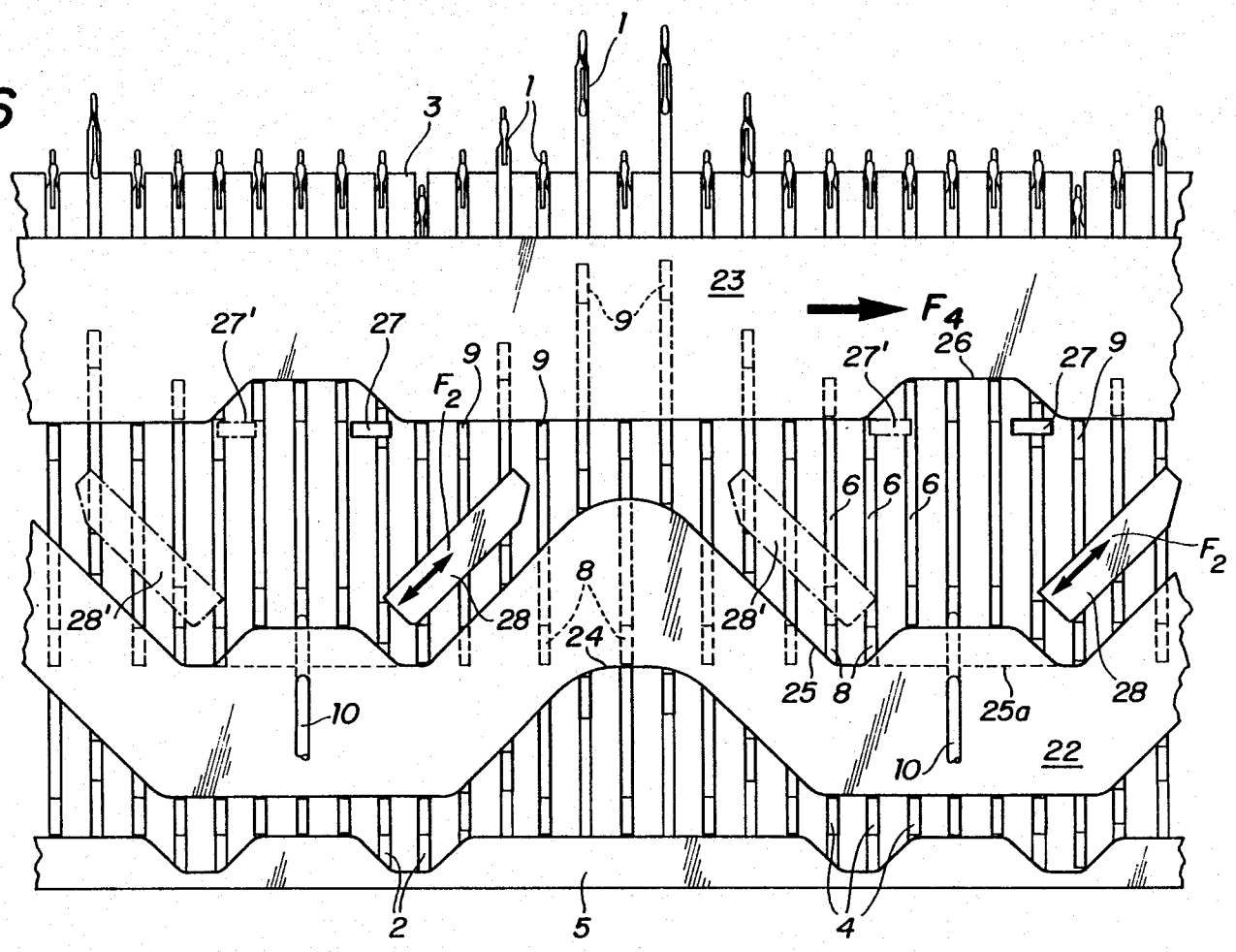
FIG. 6 is a view in elevation of a variant of FIG. 1.

FIG. 6 shows a variant in which the selection device described in relation to FIGS. 1–6 is adapted to a flat machine. In a flat loom the needle-holder or bed is fixed whereas the cam-bearing carriage moves in reciprocation. Consequently the cam profile has to be symmetrical with respect to the selection means. This variant, which in other respects is identical in operation with the embodiment in FIG. 1, will not be described again it its totality, but only the modification necessary for adapting the device to the flat machine. Since the selection mechanism proper remains unchanged, the main modifications will be to the cam contours in relation to the knocking-over or clamping cam. These cams 28, which act when the carriage bearing them moves from left to right (arrow $F_4$) must be retractable with respect to butts 8. To this end they can in known manner be moved either in the direction of the double arrows $F_2$ or perpendicular to the plane of the drawing so as to move out of the trajectory of butts 8. A second set of knocking-over cams 28', shown in chain-dotted lines, are adapted to move into the trajectories of butts 8 by perpendicular motion in the plane of the drawing when the slide bearing them moves from right to left. The contours of the respective cams 5 and 25 need to have a bend opposite cams 28', in the same way as opposite cams 28. A second set of cams 27' is adapted to actuate the cams 9 when extracted, when the carriage moves in the opposite direction to arrow $F_4$. Cams 27, 27' are therefore also adapted to move in reciprocation perpendicular to the plane of the drawing, in order to move out of the trajectory of butts 9. Cams 27 can be secured to the same mobile holder as the clamping cams 28, whereas cams 27' and 28' can be secured to another moving holder.

Figure 8:
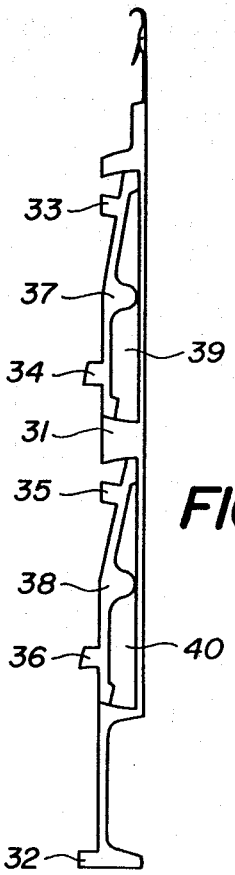
FIG. 8 is a side view of a knitting needle showing the position of the latches in connection with FIG. 7.
Figure 10:
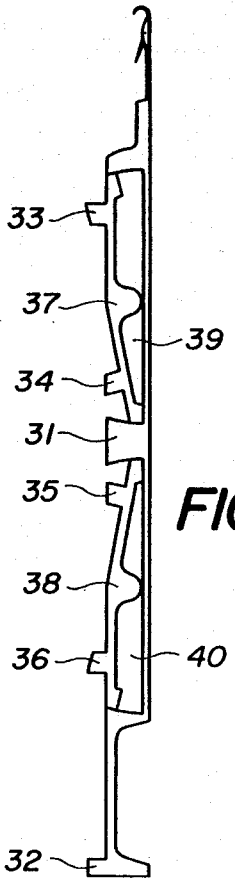
FIG. 10 is a side view of a knitting needle showing the position of the latches in connection with FIG. 9.

FIGS. 7–10 show an embodiment which is illustrated more schematically than the preceding embodiment. The drawings show the various cams and, in thicker chain-dotted lines, the trajectory of each stud projecting from the guide trick, whereas the trajectory of the other butts, which are retracted into the trick, is indicated by thinner chain-dotted lines. FIGS. 8 and 10 are side views of the positions of the latches corresponding to the trajectories illustrated by FIGS. 7 and 9 respectively. The mechanisms for selecting the position of the needles have not been shown, since they can be similar to those described previously.

Figure 7:
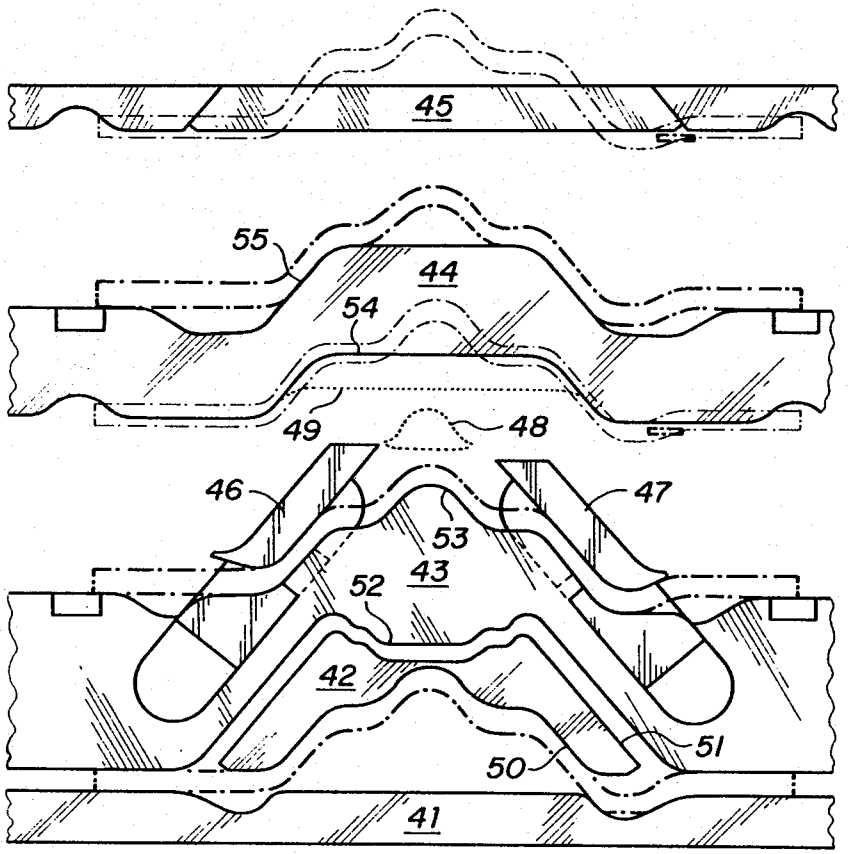
FIG. 7 is a view of a loop cam path in an embodiment with three knitting positions for a rectilinear knitting machine.

This embodiment as before comprises a needle 31 having a fixed butt 32 and four moving butts 33, 34, 35, 36 integral in pairs with two latches 37, 38 mounted for oscillation in two recesses 39, 40. The latches are similar to latch 6 in FIG. 1 and will therefore not be described again in detail, since the reader can refer, as regards their operation, to the detailed description on this subject in connection with the first embodiment. FIG. 7 shows fixed cams 41, 43, 44 and moving cams, i.e. sliding cams 46, 47 and other cams 42, 45, 48, 49 movable perpendicular to the plane of FIG. 7 so as selectively to be brought either level with the other cams or retracted. In the latter position the cams are shown by dotted lines. Some of the cams 42, 43, 44 have two active contours, i.e. 50, 51 for cam 42, 52 and 53 for cam 43 and 54, 55 for cam 44.

Thicker lines are used for the trajectories of the three butts 32, 34, 36 projecting from the guide trick of needle 31. The trajectories of the other two butts 33, 35 are indicated by thin chain-dotted lines. Although three butts inevitably project from the guide trick of needle 31 and engage the cams, the needle is actually positive guided by two butts. When the needle moves into the stitch position illustrated in FIG. 7, butts 32 and 36 guide it along the closed cam path. Incidentally, when the needle is moving upwards, the butt 36 of lever 38 engages the contour 33 of cam 44 via the lower edge of the butt, thus producing a torque which tends to hold the opposite arm of the latch against the flat bottom of recess 40. During the descending travel, the fixed butt 32 controls the descent of the needle. If, for any reason, butt 32 has to come into operation during the descending travel, this will be because the descent is too rapid, and at that moment the bottom edge of butt 32 will again act against the contour of cam 53 and again produce the torque in the same direction tending to hold the latch in its selected position, in which the arm bearing the butt 35 abuts the bottom of recess 40.

The other two knitting positions are the loop tucking position which consists in moving out the butts 34, 35 and retracting the butt 36. In that case the needle is positively controlled by the two butts whose bottom and top edges respectively engage the contour 55, 54 respectively of cam 44. The ascending movement is brought about by acting on the lower edge of butt 34 to produce a torque tending to hold the opposite arm, bearing butt 34, against the bottom of recess 39 whereas the descending movement produces a torque in the other direction by acting on the top edge of butt 35 of latch 38, producing a torque tending to hold the arm bearing butt 36 against the bottom of recess 40.

The non-knitting position is obtained when butts 32, 33, 35 project from the guide trick and the needle is guided via the top and bottom edges of butts 33 and 32 respectively.

Figure 9:
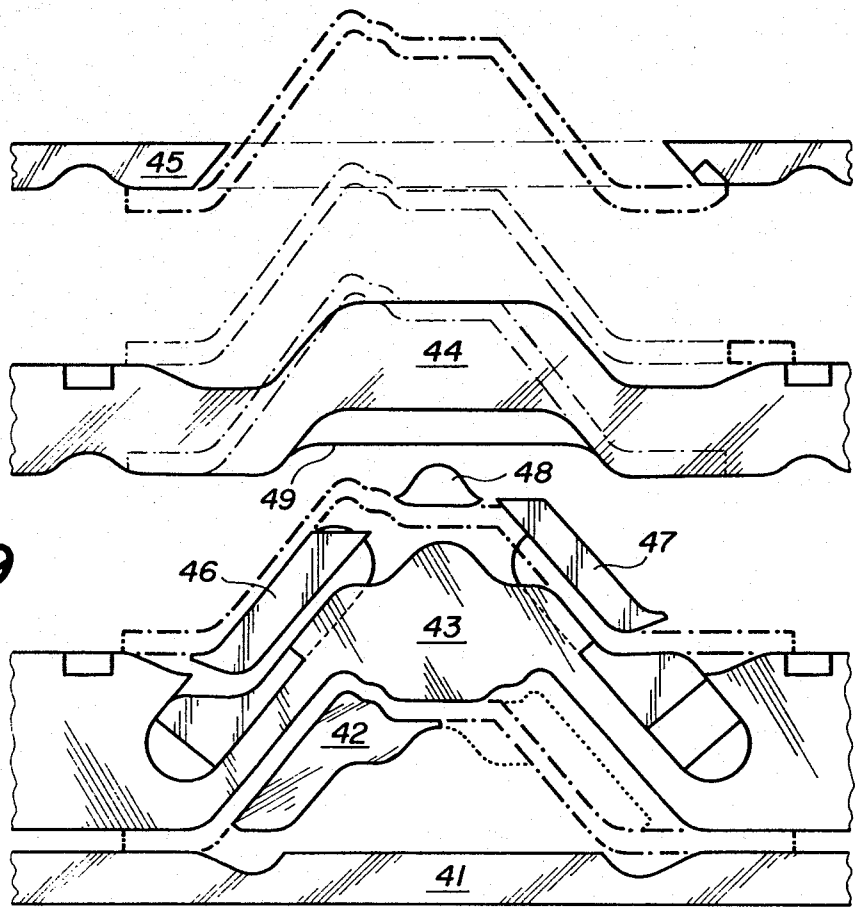
FIG. 9 shows a transfer cam path in the same embodiment.

FIG. 9 illustrates the position of the cams for transferring a stitch from the needles of one holder to another. In that case, the sliding cams 46, 47 are alternately lowered and cams 48, 49 are brought level with the other cams. Cam 45 is retracted, and so is half of cam 42. FIG. 10 shows the position of latches 37, 38 with butts 33, 36 in the position projecting from the guide trick. In this case the needle is guided by butts 32 and 26. As can be seen, during the downward motion of the needle there is an instant when the needle is not positively guided, but this is not one of the three knitting positions and consequently does not matter. In this case furthermore the latch 38 is actuated by the upper edge of butt 36, thus tending to move latch 38 into its other stable position. During this time, however, butt 35 of latch 38 is behind cam 44, which prevents the latch from tilting.

The other closure position, corresponding to the needle bed which receives loops transferred in the operation illustrated in FIGS. 9 and 10, consists in keeping the cams in the same position and in extracting the butts 33 and 35, so that the needle is guided by butt 35 alone. As before, however, this is not a knitting operation and positive guidance of the needle is not necessary in this case.

We claim:

1. In a knitting machine comprising a plurality of needles, means for controlling the knitting positions of said needles, comprising:

needle holding means, and a plurality of needle guide means thereon respectively guiding said needles for longitudinal sliding motion;

at least one needle latch on each needle, mounted for rocking motion relative to said needle;

stop means defining two end positions for said needle latch;

a respective butt in each end region of said needle latch, so arranged that in a first said end position a first said butt projects and the other said butt is retracted relative to said needle guide means, and in the other said end position the said other butt projects and the said first butt is retracted relative to said guide means; selection means adapted to bring said needle latches selectively against said stop means for thereby causing selected butts to project relative to said needle guide means;

a fixed butt on each needle, projecting relative to the needle guide means, whereby in operation each needle has at least two said butts projecting relative to said needle guide means;

cam means disposed opposite said latches for engagement with said projecting butts of said needles;

and drive means for effecting relative movement of said cam means and said needles transverse to the said guide means for thereby exerting on said projecting butts forces acting in the longitudinal directions of the needles and needle guide means for sliding the needles in the guide means;

said butts and cam means being disposed such that for each needle, the needle has at all times two projecting butts thereof in simultaneous engagement with said cam means at respective oppositely directed surfaces of said projecting butts whereby said needle is positively located in its longitudinal position by said engagement of said projecting butts and cam means.

2. A device for controlling the knitting positions of the needles of a knitting machine in which each needle is mounted for longitudinal sliding in a guide trick and comprises at least one needle latch adapted to oscillate between two stops and provided with two butts near its respective ends, the butts being adapted to project from the trick and to be respectively and alternately retracted therein, the device comprising selection means for bringing the latches against one or more of the stops and thus selectively placing the butts in the projecting position, the device also comprising cams disposed opposite the latches and drive means for bringing about relative motion between the cams and the needles transversely to the guide tricks so that the cams exert pressure on the projecting butts in the longitudinal direction of the tricks as a result of the relative motion, characterised in that each needle also comprises a fixed butt, the longitudinal position of a needle in its guide trick being controlled by simultaneous constant engagement of at least two cams with two edges, a top and bottom edge respectively, of the two butts projecting from the trick.

3. A control device according to claim 2, characterised in that the pivoting of said latch, as a result of the torque produced by the pressure of said cam against an edge of the butt on the latch projecting from the trick is limited by one or the other aforementioned stop or by the surface of said cam covering the portion of the trick into which the other butt of said latch has been retracted.

4. A control device according to claim 2, characterised in that each needle comprises two said latches such that at all times three said butts, namely one fixed and two mobile butts, project from the trick for selecting at least three knitting positions by engagement of an upper and lower edge surface respectively of two of the three projecting butts with two respective said cams.

* * * * *